US011852008B2

(12) United States Patent
Reinås et al.

(10) Patent No.: US 11,852,008 B2
(45) Date of Patent: Dec. 26, 2023

(54) WELL INSERT

(71) Applicant: EQUINOR ENERGY AS, Stavanger (NO)

(72) Inventors: Lorents Reinås, Stavanger (NO); Tore Geir Wernø, Sandnes (NO); Morten Sæther, Lillestrøm (NO); Harald Sigurd Nesse, Sandnes (NO)

(73) Assignee: EQUINOR ENERGY AS, Stavanger (NO)

( * ) Notice: Subject to any disclaimer, the term of this patent is extended or adjusted under 35 U.S.C. 154(b) by 94 days.

(21) Appl. No.: 17/602,078

(22) PCT Filed: Apr. 11, 2019

(86) PCT No.: PCT/NO2019/050081
§ 371 (c)(1),
(2) Date: Oct. 7, 2021

(87) PCT Pub. No.: WO2020/209724
PCT Pub. Date: Oct. 15, 2020

(65) Prior Publication Data

US 2022/0205355 A1 Jun. 30, 2022

(51) Int. Cl.

| | |
|---|---|
| ***E21B 43/28*** | (2006.01) |
| ***E21B 47/022*** | (2012.01) |
| ***E02D 27/52*** | (2006.01) |

(52) U.S. Cl.
CPC ..... *E21B 47/022* (2013.01); *E02D 27/52* (2013.01)

(58) Field of Classification Search
CPC ..... E21B 47/022; E21B 33/035; E21B 41/08; E02D 27/52
See application file for complete search history.

(56) References Cited

U.S. PATENT DOCUMENTS

| | | | |
|---|---|---|---|
| 3,143,172 | A | 8/1964 | Wakefield, Jr. |
| 3,489,210 | A | 1/1970 | Wakefield, Jr. |
| 3,885,623 | A | 5/1975 | Watkins et al. |
| 4,830,541 | A | 5/1989 | Shatto |
| 6,692,194 | B2 | 2/2004 | Strand |

(Continued)

FOREIGN PATENT DOCUMENTS

| | | |
|---|---|---|
| GB | 2 170 842 | 8/1986 |
| GB | 2 499 061 | 8/2013 |

(Continued)

OTHER PUBLICATIONS

International Search Report dated Nov. 4, 2019 in International Application No. PCT/NO2019/050081.

(Continued)

*Primary Examiner* — Carib A Oquendo
(74) *Attorney, Agent, or Firm* — Wenderoth, Lind & Ponack, L.L.P.

(57) ABSTRACT

A well insert for insertion into a foundation of a well is provided. The insert comprises a channel therethrough for the well; and the well insert is arranged so that when the well insert is inserted into the foundation of the well, the channel of the insert can be adjusted relative to vertical. A well assembly comprising the well insert and a well foundation is also provided as is a method of inserting a well insert and a method of controlling the orientation of a well using a well insert.

9 Claims, 2 Drawing Sheets

(56) References Cited

U.S. PATENT DOCUMENTS

| | | | | |
|---|---|---|---|---|
| 2003/0029620 | A1* | 2/2003 | Strand | E21B 33/02 405/227 |
| 2005/0002740 | A1* | 1/2005 | Andres | E21B 7/043 405/168.1 |
| 2012/0292037 | A1 | 11/2012 | Gutierrez et al. | |
| 2018/0171574 | A1* | 6/2018 | Strand | E21B 33/035 |
| 2019/0085645 | A1 | 3/2019 | Strand et al. | |

FOREIGN PATENT DOCUMENTS

| | | |
|---|---|---|
| WO | 01/65050 | 9/2001 |
| WO | 2006/046851 | 5/2006 |
| WO | 2014/116119 | 7/2014 |
| WO | 2017/014644 | 1/2017 |

OTHER PUBLICATIONS

Written Opinion of the International Searching Authority dated Nov. 4, 2019 in International Application No. PCT/NO2019/050081.

* cited by examiner

WELL INSERT

The invention relates to a method of installing a well foundation in which a well insert is provided that is for insertion into a well foundation.

US 2005/0002740 discloses a guide device for use in an offshore drilling installation which guides the riser in a desired orientation in the sea bed.

However, a well assembly can comprise a well foundation which is fixed to the ground. The well will extend through the foundation. As a result, it is important that the foundation is at the correct orientation to ensure that the resulting well is at the correct orientation. This means that it can be difficult and time consuming to install a well foundation. There is a desire to make the installation of wells comprising well foundations easier.

In a first aspect the present invention provides a method of controlling the orientation of a well, the method comprising: installing a well foundation, the foundation having a channel therethrough; measuring the angle of the foundation relative to vertical; providing a well insert, the well insert comprising a channel therethrough for a well; and inserting the well insert into a channel in the installed well foundation, wherein the well insert corrects for a misalignment of the channel in the well foundation from vertical after the foundation has been installed.

For example a method that comprises installing a well foundation, measuring the misalignment of the installed foundation from vertical, and providing an insert which can correct the misalignment such that the channel for the well can be vertical when the insert is located in the well foundation may be provided.

There may be provided a well insert for insertion into a foundation of a well, the insert comprising: a channel therethrough for the well; wherein the well insert is arranged so that when the well insert is inserted (at least in part) into the foundation of the well the angle of the channel of the insert can be adjusted relative to vertical and/or an axis of the foundation and/or the direction/orientation of the channel of the insert is adjustable.

The channel of the insert may (at least in part) extend at an angle relative to the foundation (e.g. relative to a main axis of the foundation and/or the axis of a channel of the foundation). This may be after the angle of the channel of the insert has been adjusted after insertion.

There may be provided a well insert for insertion into an installed foundation of a well, the insert comprising: a channel therethrough for the well; wherein the channel extends (at least in part) at an angle relative to a surface of the insert which, in use, engages with the foundation of the well.

The angle may be an angle other than 0 and/or 90 degrees, i.e. an oblique angle. This may be in the case that the foundation is at an angle to vertical. If it is measured that the foundation is vertical after installation, the channel of the insert may be parallel to a surface of the insert which, in use, engages with the foundation of the well. This may mean that when the insert is located in the channel of the well foundation, the channel of the insert is parallel to the channel of the well foundation in which the well insert is located.

There may be provided a well assembly, the well assembly comprising: an installed foundation comprising a channel therethrough for a well, and a well insert as described above inserted (at least in part) into the foundation.

Thus, there may be provided a well insert which may be inserted into a well foundation after the well foundation has been installed, e.g. on the sea bed.

There may also be provided a method of installing a well insert, the method comprising: providing a well insert, the well insert comprising a channel therethrough for a well; and inserting the well insert (at least in part) into an installed well foundation.

Thus, the method may comprise installing a well foundation and then, after the well foundation is installed, inserting the well insert into the well foundation.

When the well insert is inserted (at least in part) into the foundation of the well, the channel of the insert may (at least in part) extend at an angle relative to the foundation.

The angle of the channel of the insert, after the insert has been inserted into an installed well foundation, may be adjustable relative to vertical and/or the axis of the channel of the foundation.

The insert channel may extend at an angle relative to a surface of the insert which engages with the foundation of the well.

Inserting the well insert into the well foundation may provide the above described well assembly.

There may be provided a method of controlling the angle of a well in an installed well foundation, the method comprising: providing a well insert, the well insert comprising a channel therethrough for the well; and inserting the well insert into the well foundation.

Once the insert has been inserted into the well foundation the angle of the channel of the insert may be adjustable relative to vertical and/or an axis of the foundation and/or the direction/orientation of the channel of the insert may be adjustable.

When the well insert is inserted (at least in part) into the foundation of the well, the channel of the insert may (at least in part) extend at an angle relative to the foundation.

The method may be a method of controlling the orientation of a well using a well insert that is inserted into an installed well foundation.

The present invention may make the installation of well foundations easier due to the increased independency of the final well orientation relative to the well foundation orientation.

The following description of optional features is in connection with any of the above mentioned features.

The foundation may comprise a channel which is for having a well extend therethrough. The well insert may be arranged to be inserted into the channel of the foundation. The well insert is designed to be inserted into the well foundation after the foundation has been installed, i.e. the well insert is a distinct component to the well foundation. After insertion, the well insert may be fixed or locked to the foundation.

The channel of the insert, when inserted into the well foundation, may extend at an angle relative to a channel of the foundation.

The channel of the insert, when inserted into the well foundation, may extend parallel and/or coaxial with a channel of the foundation. This may be the case if it was determined that the there is no offset between the channel of the well and vertical.

Thus, if it is determined that there is no offset between the channel of the well foundation and vertical, the method may comprise providing and inserting a well insert which has a channel that is parallel to the channel of the well foundation.

The axis, or at least a part of the axis, of the channel of the insert may be at an angle to the main axis of the well insert.

The channel of the insert may be straight, at least in part.

The channel may be curved, at least in part. For example the channel of the insert may have a pre-determined curvature.

One of the channels may be vertical and the other may be non-vertical, both channels may be non-vertical but by different angles, or both channels may be vertical.

The insert channel may extend at an angle relative to a surface of the insert which engages with the foundation of the well.

The well insert may make it easier for the direction of a well through an installed well foundation to be controlled.

The well insert may be rotated/rotatable within the channel of the foundation. The well insert may be rotatable about its main axis.

This may allow the angle of the well insert channel to be adjusted relative to a vertical axis (i.e. a direction parallel to the direction of gravity) and/or the main axis of the channel of the foundation. Additionally or alternatively, this may allow the direction/orientation of the channel of the insert to be adjustable. The connection between the well insert and the channel of the foundation may be such that rotation can be controlled, i.e. rotation can be allowed or prevented.

If rotation is prevented, e.g. the insert is locked in place, this may be permanent or reversible, i.e. it may not be possible to adjust the orientation again or the insert may be able to be unlocked so that it can be rotated again, i.e. the prevention of the rotation may be irreversible or reversible.

Because the well insert has a channel therethrough which may extend at an angle relative to the outer and/or engagement surface of the insert it may be possible to provide a well which extends at an angle relative to the foundation of the well.

For example, if the well foundation is installed such that the channel through the foundation for the well is not vertical, or not vertical within an acceptable limit, such as greater than 1, 1.2, 1.5, or 2.0 degrees from vertical, the well insert may be used to make the channel for the well vertical or vertical within the acceptable limit.

This means that the foundation may be installed with less required control on its verticality. This is because the verticality of the pipe for the well may be provided by providing an insert which corrects for the misalignment of the channel through the foundation from vertical after the foundation has been installed.

Alternatively, in some scenarios (although not currently claimed), such in the case of a well with a small overburden, it may be desirable to have the channel for the well which is not vertical. This is because the direction of the well may need to change over a very short distance (due to the small overburden) and thus it may be desirable to use an insert to provide a channel for the well in the foundation which is substantially not vertical, e.g. greater than 2, 5, 10, 15, 25 or 45 degrees from vertical.

It may be easier to provide a well insert which has a channel which is not vertical rather than providing a well foundation which is non-vertical by a desired amount.

The channel in the insert and/or the well foundation may be elongate. The channel may be a conduit/pipe. The channel may be formed by a hollow member. The cross section may be circular or any other poly-sided closed shape.

In embodiments the channel in the foundation may be substantially non-vertical, such as greater than 1, 1.2, 1.5, or 2.0 degrees from vertical and the well insert may be designed/arranged so that the channel through the well insert, when inserted into the foundation, is substantially vertical, or vertical within 1, 1.2, 1.5, or 2.0 degrees.

Alternatively, the well insert may be designed/arranged so that the channel through the well insert, when inserted into the foundation, is substantially non-vertical. In this case the channel through the well foundation may be substantially vertical, vertical within an acceptable limit, or itself also non-vertical.

The well insert may be designed/arranged so that the channel through the well insert, when inserted into the foundation, is at a smaller angle from vertical than the channel through the foundation. In the case of a curved channel through the insert, it may be that the tangent to the axis of the channel at the bottom opening is at a smaller angle (including 0 degrees) from vertical than the channel through the foundation.

At one end the channel of the well insert when inserted into the foundation may be concentric with the channel of the foundation. In this case, the other end of the channel of the well insert may be eccentric with the channel of the foundation. For example, the top end of the channel of the well insert may be eccentric with the channel of the foundation and the bottom end may be concentric. Alternatively, the bottom end may be eccentric with the channel of the foundation and the top end may be concentric.

Alternatively, both ends of the channel of the well insert may be eccentric with the channel of the foundation.

The well insert may comprise a surface (such as an outer surface) which, when the well insert is inserted into the foundation of a well, engages (directly or indirectly) with the foundation.

The outer surface (or at least part of the outer surface) of the insert may, in use, engage with the foundation of the well. The surface may be the surface which engages with the well foundation when the insert is inserted into the foundation. The surface may therefore be referred to an engagement surface.

When the well insert is inserted into a foundation the main axis of the channel through the well insert may be at an angle to the main axis of a channel through the foundation.

The well insert may be referred to as an adaptor and/or a cassette. The well insert may be a separate component from the well foundation, i.e. it is not integral with the well foundation.

The well insert may be an interchangeable part. For example, there may be a number of well inserts for insertion into a given well foundation. After the well insert has been inserted into the well insert, the well insert may be removed from the foundation if desired. For example, a well insert may be inserted into a foundation to give a channel for a well at a given angle relative to vertical, and after a period of time that well insert may be retrieved from the well foundation and replaced with a different well foundation so as to give a channel for a well which is at a different angle relative to vertical compared to the first well insert.

The channel through the insert and/or the foundation may be a conduit.

The channel through the insert may be referred to as a first channel and/or an insert channel and the channel through the foundation may be referred to as a second channel and/or a foundation channel.

The channel through the insert may be for having production tubing extend therethrough.

The well insert may be used to establish a mechanical connection between the well foundation and the well.

The insert may replace/be the casing of a well assembly.

The foundation, in use, may be located in the ground, e.g. sea bed, in which the well is formed.

The foundation may provide an interface between the well assembly and the ground in which the well is located.

The method may comprise installing the well foundation. Because of the present invention, it may be possible to install the well foundation without it being at the angle desired for the resulting well. Thus, the well insert may make the installation of the well foundation easier, cheaper and/or quicker.

The well foundation may be a conductor pipe. The conductor pipe may have been installed in the ground (which in the case of a subsea well may be the seabed), such as having been piled into the ground.

The foundation may be a suction anchor. The suction anchor may have an inner pipe (which may be located within a suction skirt of the suction anchor) for receiving the well insert.

The well may be an oil and/or gas well.

The well may be a subsea well.

The plane of the ground (which in the case of a subsea well will be the seabed) may define a horizontal direction. A vertical direction may be the direction which is perpendicular to the horizontal direction or perpendicular to the plane of the ground.

Vertical may be the direction which is parallel to the direction of gravity.

The direction of the insert and/or the channel of the insert may be the direction in which the central axis of the channel extends.

The direction of the foundation may be the direction of the central axis of the foundation. This may be the same as the direction of the central axis of the channel of the foundation.

The angle between the channel of the insert and the foundation may be the angle between the direction of the channel and the direction of the foundation.

The channel through the insert may be for having production tubing extend therethrough.

The insert may be a solid body with the channel through the solid body. The outer surface (or at least a portion of the outer surface) may engage with the foundation of the well when the insert is inserted into the well foundation.

The angle of the channel of the insert relative to the outer and/or engagement surface of the insert may be fixed.

In this case, the method may comprise obtaining a well insert with an appropriate angle between the channel of the insert and the outer and/or engagement surface of the insert.

The method may comprise inserting the well insert into the well foundation and then rotating the insert so as to adjust the angle and/or orientation of the channel of the insert. The method may comprise measuring the orientation of the foundation, such as the orientation relative to the plane of the ground in which the foundation is installed and/or relative to the direction of gravity (i.e. vertical). It may then be determined what is the appropriate angle between the channel of the insert and the outer and/or engagement surface of the insert.

The method may comprise determining the offset between the channel of the well foundation and vertical.

The method may comprising choosing an appropriate well insert based on the orientation of the foundation.

For example, if it is determined that the channel through the foundation for the well is not vertical within an acceptable limit, such as within 1, 1.2, 1.5, or 2.0 degrees of vertical, a well insert with a channel angled relative to its engagement surface which will result in the channel insert for the well being vertical or vertical within the acceptable limit may be obtained.

Once the desired angle of the channel relative to the engagement surface is determined, an appropriate well insert may be made.

Alternatively, a plurality of well inserts may be provided, wherein each of the well inserts has a different angle between channel of the insert and the outer and/or engagement surface of the insert. Thus, the method may comprise choosing an appropriate well insert from a plurality of inserts.

Thus the method may comprise providing a plurality of well inserts, wherein each of the well inserts has a different angle between channel of the insert and the outer surface of the insert; and wherein the method comprises selecting an appropriate well insert from the plurality of well inserts and inserting the selected well inset into the channel in the installed well foundation.

For example, a plurality of well inserts may be provided in which the angle between channel of the insert and the outer and/or engagement surface of the insert for each of them differs by at least 0.5 degrees, or at least 1 degree. For example a well insert may be provided with an angle between channel of the insert and the outer and/or engagement surface of the insert of 0.5 degrees, another with an angle of 1 degree, another with an angle of 1.5 degree and so forth.

Thus the well inserts of the plurality of well inserts may each have angle between the channel of the insert and the outer surface of the insert that differs by at least 0.5 degrees from the other well inserts of the plurality of well inserts.

In this way, it is possible to determine the offset between the channel of the well foundation and vertical and then chose an appropriate well insert from the plurality of well inserts such that the channel through the well insert when the well insert is inserted into the well foundation is vertical or vertical within an acceptable limit or alternatively at another desired angle from vertical.

Thus there may be provided a plurality of well inserts, wherein each of the well inserts is for insertion into a foundation of a well, each insert comprising: a channel therethrough for the well; wherein each well insert is arranged so that when the well insert is inserted into the foundation of the well, the channel of the insert will extend at an angle relative to the foundation; and wherein each insert has a different angle between channel of the insert and the surface of the insert which, in use, engages with the foundation of the well of the insert.

The angle of the channel of the insert relative to the outer and/or engagement surface of the insert and/or the well foundation may be adjustable.

The method may comprise measuring the orientation of the foundation, such as the orientation relative to the plane of the ground in which the foundation is installed. It may then be determined what is the appropriate angle between the channel of the insert and the outer and/or engagement surface of the insert.

The angle of the channel may then be adjusted based on the angle of the foundation. The angle of the channel may be adjusted and fixed in a position before being inserted into the well foundation or after being inserted into the well foundation.

The angle of the channel may be adjusted so that it is vertical or a chosen (e.g. desired) angle from vertical when it is inserted into the well foundation.

For example, the insert may comprise a central pipe (which forms the channel for the well), the angle of the pipe being able to be adjusted relative to the engagement surface of the well insert.

The pipe may be attached to the engagement surface of the well insert at one end for example such a way that the other end can be moved to allow the angle of the channel in the insert to be adjusted.

When the angle of the channel of the insert is adjustable, the insert may be preinstalled in the well foundation before the well foundation is installed.

The channel of the insert for the well may have an angle which matches and/or corrects the misalignment of the foundation (more specifically the channel of the foundation) from a desired orientation, which may for example be vertical.

Once inserted into the well foundation the well insert may be fixed in place. Once inserted into the well foundation the well insert may be fixed in place at a desired point in time. This may be immediately after insertion or sometime after insertion.

The insert may be fixed in place by the insert being welded, cemented or glued in the foundation for example. Alternatively or additionally this may be achieved by the insert being locked to the foundation by a locking mechanism for example.

The well insert may be attached to the well foundation such that a hydraulic seal is formed between the well insert and the foundation.

The method may comprise installing a foundation, wherein the orientation of the foundation is not controlled (or at least not tightly controlled). For example, the foundation may be allowed to orient itself based on its own weight. The method may then comprise using the well insert to correct for any misalignment of the channel of the foundation for the well from the desired orientation.

The method may comprise measuring the angle of an installed foundation relative to the ground. This may be performed by means of a site survey.

The angle of the channel in the well insert may be dependent on the angle of an installed foundation relative to the ground.

Certain preferred embodiments of the present invention will now be described by way of example only with reference to the accompanying drawings, in which.

Figure 1:
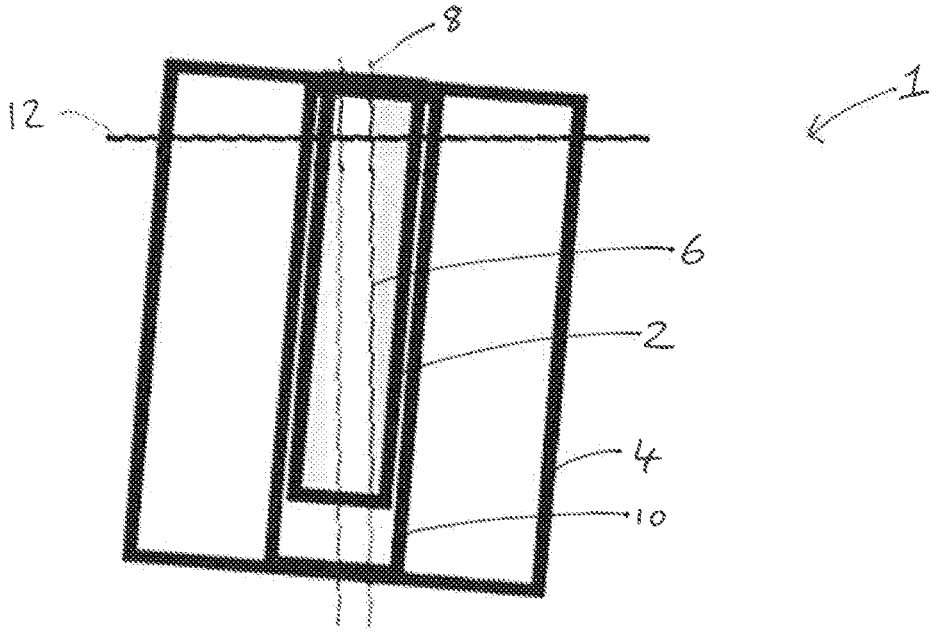
FIG. 1 shows an exemplary well insert.

FIG. 1 shows a well assembly 1 in which a well insert 2 is inserted into a well foundation 4. The well insert 2 has a channel 6 therethrough for a well 8. The well foundation 4 has a channel 10 which is for letting the well 8 extend therethrough. The channel 10 of the foundation accommodates the well insert 2. As can be seen in the figure, the well foundation 4 and thus the channel therethrough is at an angle from vertical (wherein vertical is the direction perpendicular to the ground 12 in which the foundation is located).

In order that the well 8 can be vertical (or near vertical) despite the angle of the foundation 4, the insert 2 is provided in the well foundation 4. The channel 6 through the insert 2 extends at an angle to the surface of the insert 2 which engages with the well foundation 4. The channel 6 through the insert 2 also extends at an angle to the main axis of the insert 2. Thus when the insert 2 is inserted into the channel 10 of the foundation, the channel 6 through the insert 2 extends at an angle to the channel 10 of the foundation. The angle between the channel 6 and the engagement surface of the insert 2 can be chosen so that when the insert 2 is inserted into the foundation 4 the channel 6 in the insert is vertical relative to the ground 12 in which the foundation 4 is located.

Figure 2:
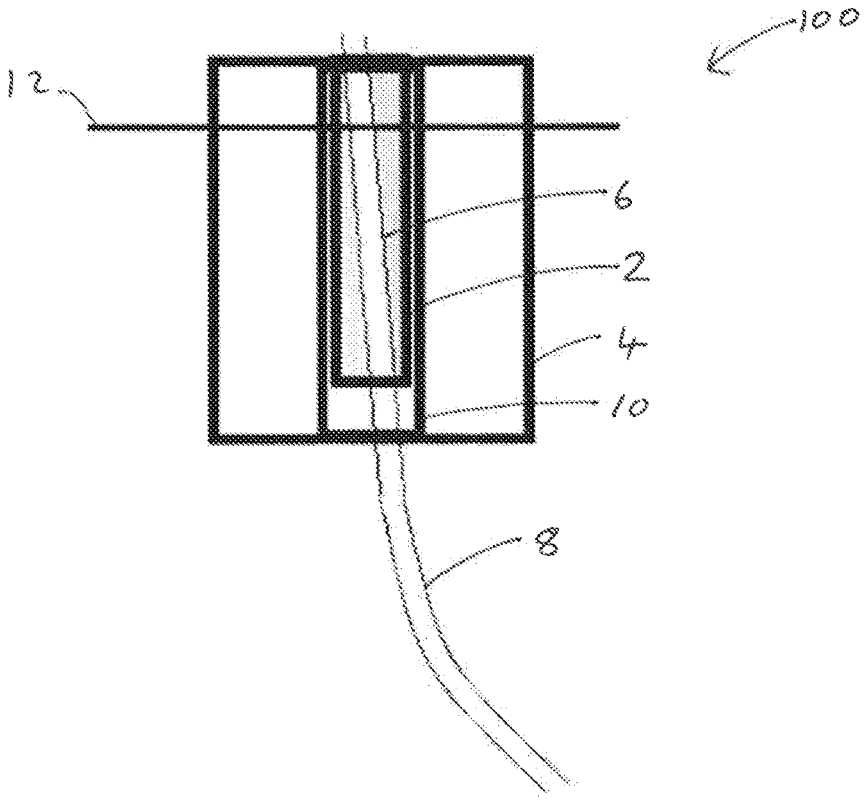
FIG. 2 shows another exemplary (currently not claimed) well insert.

FIG. 2 shows an alternative assembly 100 in which the foundation 4 is vertical relative to the ground 12. In this case the insert 2 is used to deliberately make the well 8 extend at an angle from vertical (relative to the ground 12) through the insert 2 and foundation 4. This may be particularly useful in environments in which it is necessary for the well to transition to a horizontal well over a relatively short depth (such as in cases in which there is a fairly small overburden above the well).

In either case, the channel 6 in the insert 2 may be fixed. An insert 2 with a suitable angled channel 6 will be chosen for the application depending on how far from vertical the foundation is in the first example (described in connection with FIG. 1) or how angled it is desired for the well to be in the second example (described in connection with FIG. 2).

It may be that there are a plurality of inserts 2 each which a different angle between the channel 6 and the engagement surface. Thus, once the foundation 4 has been installed, a site survey may be carried out to determine the angle of the foundation 4 relative to vertical. An appropriate insert 2 from the plurality of inserts may be chosen. This insert 2 may have a channel at an angle which compensates for the misalignment between the foundation 4 and the vertical position.

Alternatively, the angle of the channel 6 of the insert relative to the outside engagement surface of the insert 2 which engages with the foundation 4 in use may be adjustable. Thus, the channel 6 may be moved to an appropriate angle once it is known what angle is required to compensate for the angle of the foundation 4.

Figure 3:
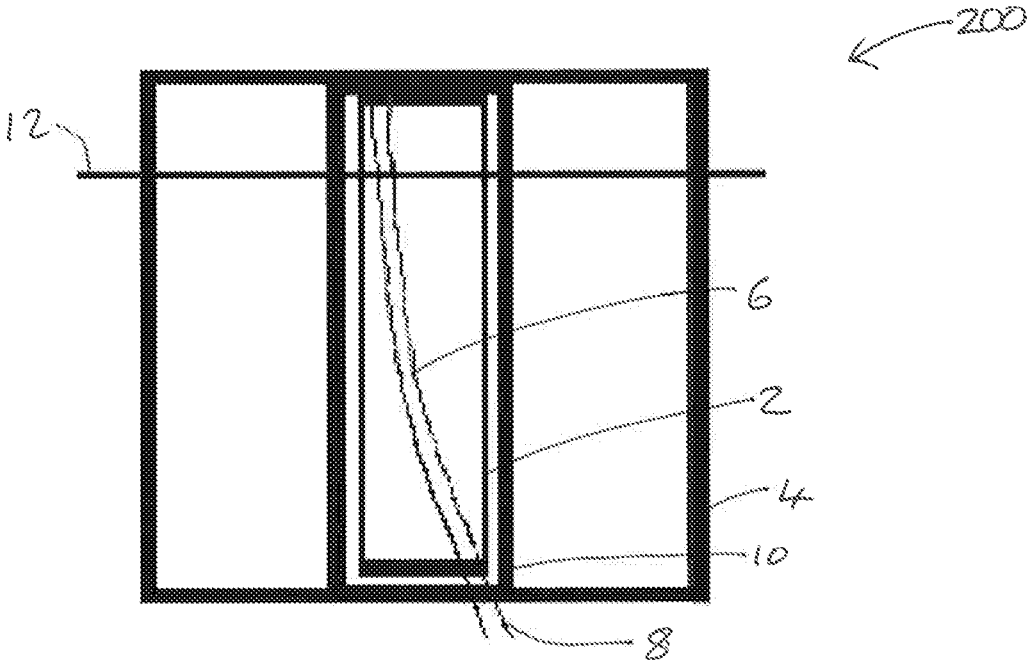
FIG. 3 shows yet another exemplary well insert.

FIG. 3 shows an example insert 2 in which the channel 6 through the insert 2 is curved. This can also be used to provide a well which extends at an angle relative to the angle of the axis of the foundation or relative to vertical.

The following clauses set out features of the invention which may not presently be claimed in this application, but which may form the basis for further amendment or a divisional/continuation application.

1. A well insert for insertion into a foundation of a well, the insert comprising:

a channel therethrough for the well;

wherein the well insert is arranged so that when the well insert is inserted into the foundation of the well, the angle of the channel of the insert is adjustable relative to vertical.

2. A well insert according to clause 1, wherein the well insert is arranged so that when the well insert is inserted into the foundation of the well, the channel of the insert will extend at an angle relative to the foundation.

3. A well insert according to clause 1 or 2, wherein the axis of the channel of the insert is at an angle to a main axis of the well insert.

4. A well insert according to clause 1, 2 or 3, wherein the channel extends at an angle relative to a surface of the insert which, in use, engages with the foundation of the well.

5. A well insert according to any preceding clause, wherein, when the well insert is inserted into the foundation of the well the well insert is rotatable relative to the foundation.

6. A well insert according to any preceding clause, wherein the angle of the channel of the insert relative to the surface which, in use, engages with the foundation of the well of the insert is fixed.

7. A well insert according to any of clauses 1 to 5, wherein the angle of the channel of the insert relative to the surface of the insert which, in use, engages with the foundation of the well of the insert is adjustable.

8. A well assembly, the well assembly comprising:

a foundation comprising a channel therethrough for a well, and a well insert according to any preceding clause.

9. A well assembly according to clause 8, wherein, when the well insert is inserted into the foundation, the main axis of the channel through the well insert is at an angle to the main axis of the channel through the foundation.

10. A well assembly according to clause 8 or 9, wherein the channel in the foundation is non-vertical, and the well insert is arranged so that the channel through the well insert, when inserted into the foundation, is vertical.

11. A well assembly according to clause 8, 9 or 10, wherein the well assembly is arranged so that, when the well insert is inserted into the foundation, the well insert is rotatable within the channel of the foundation.

12. A plurality of well inserts, wherein each of the well inserts is for insertion into a foundation of a well, each insert comprising:

a channel therethrough for the well;

wherein each well insert is arranged so that when the well insert is inserted into the foundation of the well, the channel of the insert will extend at an angle relative to the foundation; and wherein each insert has a different angle between channel of the insert and the surface of the insert which, in use, engages with the foundation of the well of the insert.

13. A plurality of well inserts according to clause 12, wherein each of the inserts is an insert according to any of clauses 1 to 7.

14. A method of installing a well insert, the method comprising:

providing a well insert, the well insert comprising a channel therethrough for a well; and inserting the well insert into an installed well foundation, wherein, when the well insert is inserted into the foundation of the well, the channel of the insert extends at an angle relative to the foundation.

15. A method of controlling the angle of a well in an installed well foundation, the method comprising:

providing a well insert, the well insert comprising a channel therethrough for the well; and inserting the well insert into the well foundation.

16. A method according to clause 14 or 15 wherein the well insert is a well insert according to any of clauses 1 to 7.

17. A method according to clauses 14, 15 or 16, wherein the foundation comprises a channel which is for having a well extend therethrough and wherein the method comprises inserting the well insert into the channel of the foundation.

18. A method according to any of clauses 14 to 17, wherein the method comprises obtaining information regarding the orientation of the foundation.

19. A method according to clause 18, wherein the method comprises choosing a well insert based on the orientation of the foundation.

20. A method according to clause 19 or 20, wherein the angle of the channel of the insert is adjustable, and wherein the angle of the channel is adjusted based on the orientation of the foundation.

The invention claimed is:

1. A method of controlling the orientation of a well, the method comprising:

installing a well foundation, the foundation having a channel therethrough;

measuring an angle of the foundation relative to vertical;

providing a well insert, the well insert comprising a channel therethrough for the well; and inserting the well insert into the channel in the installed well foundation, wherein the well insert corrects for a misalignment of the channel in the well foundation from vertical after the foundation has been installed.

2. The method according to claim 1, wherein the method comprises determining an offset between the channel of the well foundation and vertical.

3. The method according to claim 1, wherein based on the measurement of the angle of the foundation relative to vertical it is determined what is an appropriate angle between the channel of the insert and an outer surface of the insert.

4. The method according to claim 1, further comprising:

providing a plurality of well inserts, wherein each of the well inserts has a different angle between the channel of the insert and the outer surface of the insert; and selecting an appropriate well insert from the plurality of well inserts and inserting the selected well inset into the channel in the installed well foundation.

5. The method according to claim 4, wherein each of the plurality of well inserts has an angle between the channel of the insert and the outer surface of the insert that differs by at least 0.5 degrees from the other well inserts of the plurality of well inserts.

6. The method according to claim 1, wherein once the appropriate angle of the channel of the insert relative to the outer surface of the insert is determined, the method comprises making an appropriate well insert that has the appropriate angle between the channel of the insert and an outer surface of the insert.

7. The method according to claim 1, wherein the angle of the channel of the well insert relative to the channel of the well foundation is adjusted based on the measured angle of the foundation by rotating the insert.

8. The method according to claim 1, further comprising allowing the well foundation to have any orientation while installing the well foundation.

9. The method according to claim 1, wherein, if it is determined that there is no offset between the channel of the well foundation and vertical, the method comprises providing and inserting a well insert which has a channel that is parallel to the channel of the well foundation.

* * * * *